US007432449B2

(12) United States Patent
Kim

(10) Patent No.: US 7,432,449 B2
(45) Date of Patent: Oct. 7, 2008

(54) ELECTRICAL POWER LINE INSULATOR WITH END CLAMP

(76) Inventor: Bong Joo Kim, Pyungil Bldge. 1475-10, Gyanyang 2-Dong, Dongan-Guanyang-Si, Gyeonggi-Do (KR)

( * ) Notice: Subject to any disclaimer, the term of this patent is extended or adjusted under 35 U.S.C. 154(b) by 61 days.

(21) Appl. No.: 11/543,805

(22) Filed: Oct. 6, 2006

(65) Prior Publication Data

US 2008/0083555 A1 Apr. 10, 2008

(51) Int. Cl.
*H01B 17/00* (2006.01)

(52) U.S. Cl. ..... 174/138 F; 174/169; 174/186; 174/82; 248/74.4; 24/525

(58) Field of Classification Search ..... 174/169, 174/186, 191, 138 F, 137 R, 40 R, 170, 168, 174/146, 174, 172, 154, 82, 74 A, 196, 77 R; 248/74.4, 231.4, 316.4; 24/525
See application file for complete search history.

(56) References Cited

U.S. PATENT DOCUMENTS 3,737,560 A * 6/1973 Takatori et al. ..... 174/158 R
4,579,306 A * 4/1986 Kellett et al. ..... 248/74.1
4,731,507 A * 3/1988 Torimoto et al. ..... 174/139
5,064,971 A * 11/1991 Bogdanow ..... 174/169
5,837,943 A * 11/1998 Kellett ..... 174/169

* cited by examiner

*Primary Examiner*—Dhiru R Patel
(74) *Attorney, Agent, or Firm*—Katten Muchin Rosenman LLP

(57) ABSTRACT

An electrical power line insulator has an end clamp with a saddle for supporting an electrical wire, a track provided on a front surface of the saddle, a keeper for compressing and supporting an electrical wire seated in the saddle, a bolt and a nut for fastening the keeper to the saddle and operable to horizontally move the keeper along the track, and an insulator housing secured to the end clamp and mounted on a support structure. The end clamp and the insulator housing are detachably assembled with each other by means of a cylindrical clamp base integrally provided on a lower portion of the saddle and the track of the clamp and an upper fitting part. The upper fitting part has an assembly cylinder provided on an upper portion of the fitting part to be connected to the cylindrical clamp base, a compression cylinder provided on a lower portion of the fitting part and pressed against a post of the insulator housing, and a bolt and a nut fastening the cylindrical clamp base of the clamp to the assembly cylinder of the upper fitting part.

7 Claims, 8 Drawing Sheets

ELECTRICAL POWER LINE INSULATOR WITH END CLAMP

FIELD OF INVENTION

The present invention relates to electrical power line insulators.

BACKGROUND OF THE INVENTION

An electrical power line insulator having an end clamp is usually used to support an electrical wire of a distribution line. After the electrical wire is seated in a saddle, a keeper is moved in a track to tightly engage and support the outer portion of the electrical wire.

Electrical power line insulators having such end clamps have been developed using various technologies over several decades. Recently, in order to enhance the safety and convenience of installation, technologies improved in various ways have been suggested.

Electrical power line insulators are classified either as separated-type or integrated-type. A separated-type electrical power line insulator is constructed so that an end clamp for supporting an electrical power line and an insulator housing mounted on a support structure, such as a cross arm of an electric pole, are manufactured separately and are then assembled with each other. An integrated-type electrical power line insulator is constructed so that an end damp and an insulator housing are integrated into a single structure.

In the separated-type electrical power line insulator, an extension leg of the end damp supporting an electrical wire is connected to a fitting part provided on the upper portion of the insulator housing. By tightening a bolt which passes through the insulator housing so as to be opposite the fitting part, the end clamp is attached to the insulator housing.

In such a separated-type structure, the end clamp can be freely rotated because of an annular groove which is cut on the outer circumferential surface of the extension leg, when the bolt of the fitting part is loosened to some extent, thus freely accommodating the distribution direction or angle of the electrical wire, therefore being convenient to use. However, the separated-type structure is problematic in that the bolt must be securely tightened after the installation. A safety device for preventing the bolt from coming loose is unsatisfactory.

In other words, the separated-type structure is problematic in that, even if the bolt fastening the end clamp to the insulator housing is firmly tightened, after a long period of time passes following installation, the electrical wire is repeatedly shaken by external forces, such as strong wind, thus causing the insulator to vibrate, therefore loosening the bolt. Consequently, the end clamp moves while rotating freely, and consequently an end portion of the saddle of the clamp applies shearing stress to the electrical wire in the distribution direction thereof, thus causing an accident such as breakage of the wire.

Therefore, recently, the integrated-type electrical power line insulator, that is a one-piece-type electrical power line insulator constructed so that the extension leg of the end clamp and the insulator housing compress and secure the post to be integrated with each other, has been suggested.

However, a one-piece-type insulator has several drawbacks compared to a separated-type insulator. Problems with the one-piece-type electrical power line insulator will be described below.

Firstly, a one-piece-type insulator is problematic in that, when either the end clamp or the insulator housing is partially damaged, the end clamp or the insulator housing cannot be separated from each other, so that the entire insulator must be replaced with a new one.

During or after installation, damage to an electrical power line insulator, for example damage to the saddle of the end clamp, damage to the insulator housing due to careless handling during installation and transport, tearing caused by the beak of a bird, such as an eagle or a hawk, or damage to insulating rubber caused by alkalinity of coastal areas, leads to interruption of the electric current. In order to respond to such an incident, the entire insulator must be replaced with a new one. This is very inefficient in terms of economics.

Secondly, a one-piece-type electrical power line insulator is problematic in that it is difficult to tighten a conductor (electrical power line).

A one-piece-type electrical power line insulator is installed as follows. An auxiliary working tool (eyenut) is assembled with a protruding end of a bolt fastening the saddle of the clamp to the keeper moving in the clamp, and a working tool, such as a pulley, is connected to the auxiliary working tool. The electrical wire is then raised up and is seated in the saddle using the pulley. Next, a worker must promptly tighten the bolt. However, the working tool must be removed before it is possible to tighten the bolt. This is inconvenient and inefficient in terms of time.

Thirdly, a one-piece-type electrical power line insulator is problematic in that corrosion may cause a structural problem related to the saddle receiving the keeper, so that a long life span is not ensured.

In a one-piece-type electrical power line insulator, the lower portion of the track guiding the keeper is closed, so that water collected in the track is not drained, and the collected water causes corrosion of the clamp. Especially in coastal areas having high alkalinity, corrosion proceeds quickly. Thereby, insulating performance is lowered due to breakdown, and the life span of the insulator is reduced.

SUMMARY OF THE INVENTION

The present invention has been made keeping in mind the above problems occurring in the prior art. The present invention provides an electrical power line insulator having an end clamp, in which an end clamp and an insulator housing are firmly assembled in such a way as to be separated from each other using a bolt, so that it is possible to replace only a damaged part with a new one.

The present invention also provides an electrical power line insulator having an end clamp which allows an auxiliary working tool to be secured to a bolt which fastens the end clamp to an insulator housing, thus enabling tightening of a keeper immediately after an electrical wire has been seated in the saddle.

The present invention further provides an electrical power line insulator having an end clamp which is constructed so that it is possible to tighten a bolt operating a keeper using either a bolt head or a nut.

The present invention also provides an electrical power line insulator having an end clamp in which drain holes are formed in a track of a saddle and a clamp base to prevent rainwater from remaining therein, thus minimizing corrosion during use. The present invention reduces the risk of breakdown, thus minimizing accidents such as interruption of electric current.

According to one aspect, the present invention provides an electrical power line insulator including an end clamp having a clamp which has a saddle so that an electrical wire can be seated therein, a keeper which compresses and secures the electrical wire, moving at the side facing the saddle and seated in the saddle, in cooperation with the saddle, and a bolt and a nut which assemble the clamp and the keeper with each other, and including an insulator housing secured to the end clamp, and provides an electrical power line insulator in which a clamp base provided on the lower portion of the clamp comprises a hollow cylindrical connector so that the end clamp and the insulator housing can be separately manufactured and are assembled with each other, and in which the insulator housing includes an assembly cylinder having on an upper portion thereof a fitting part so that it fits into the cylindrical connector of the clamp base, and a compression cylinder coupled to a post of the insulator housing to be compressed and assembled, and the clamp base is secured to the assembly cylinder of the upper fitting part via a bolt, and in which the clamp has drain holes in the upper surface of the clamp base and the upper and lower surfaces of a vertical wall in the track which is provided on the front of the saddle and guides the keeper.

According to another aspect of the invention, an electrical power line insulator includes an end clamp, an upper fitting part, and a bolt and nut. The end clamp has a clamp which includes a saddle for supporting an electrical wire, a track provided on a front surface of the saddle, and a cylindrical clamp base provided under the track and the saddle, a keeper for compressing and supporting the electrical wire seated in the saddle, and a bolt and a nut for fastening the keeper to the saddle to horizontally move the keeper received in the track. The upper fitting part includes an assembly cylinder which is provided on an upper portion of the fitting part to be connected to the cylindrical clamp base of the saddle, and a compression cylinder provided on a lower portion of the fitting part to be pressed against a post of the insulator housing. The bolt and the nut fasten the cylindrical clamp base of the clamp to the assembly cylinder of the upper fitting part.

According to yet another aspect of this invention, drain holes are formed in the upper and lower surfaces of vertical walls of the track of the clamp and the upper surface of the clamp base, thus preventing rainwater from collecting therein.

According to a still further aspect of this invention, the saddle of the clamp further includes reinforcing ribs, the reinforcing ribs being provided on an outer portion of a seat in which the electrical wire is seated.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF PREFERRED EMBODIMENT

Figure 1:
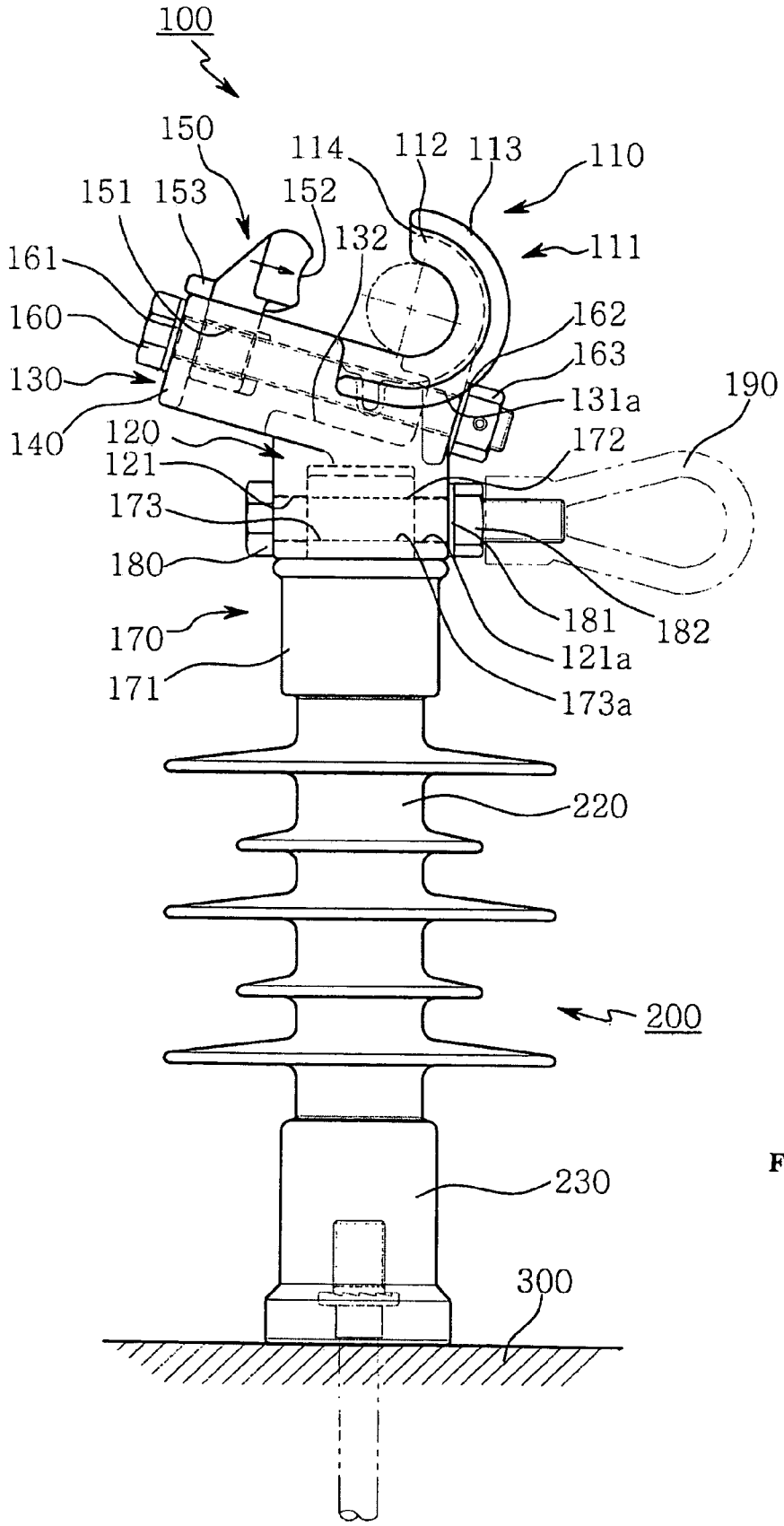
FIG. 1 is a side view of an insulator in accordance with one embodiment of the invention.
Figure 2:
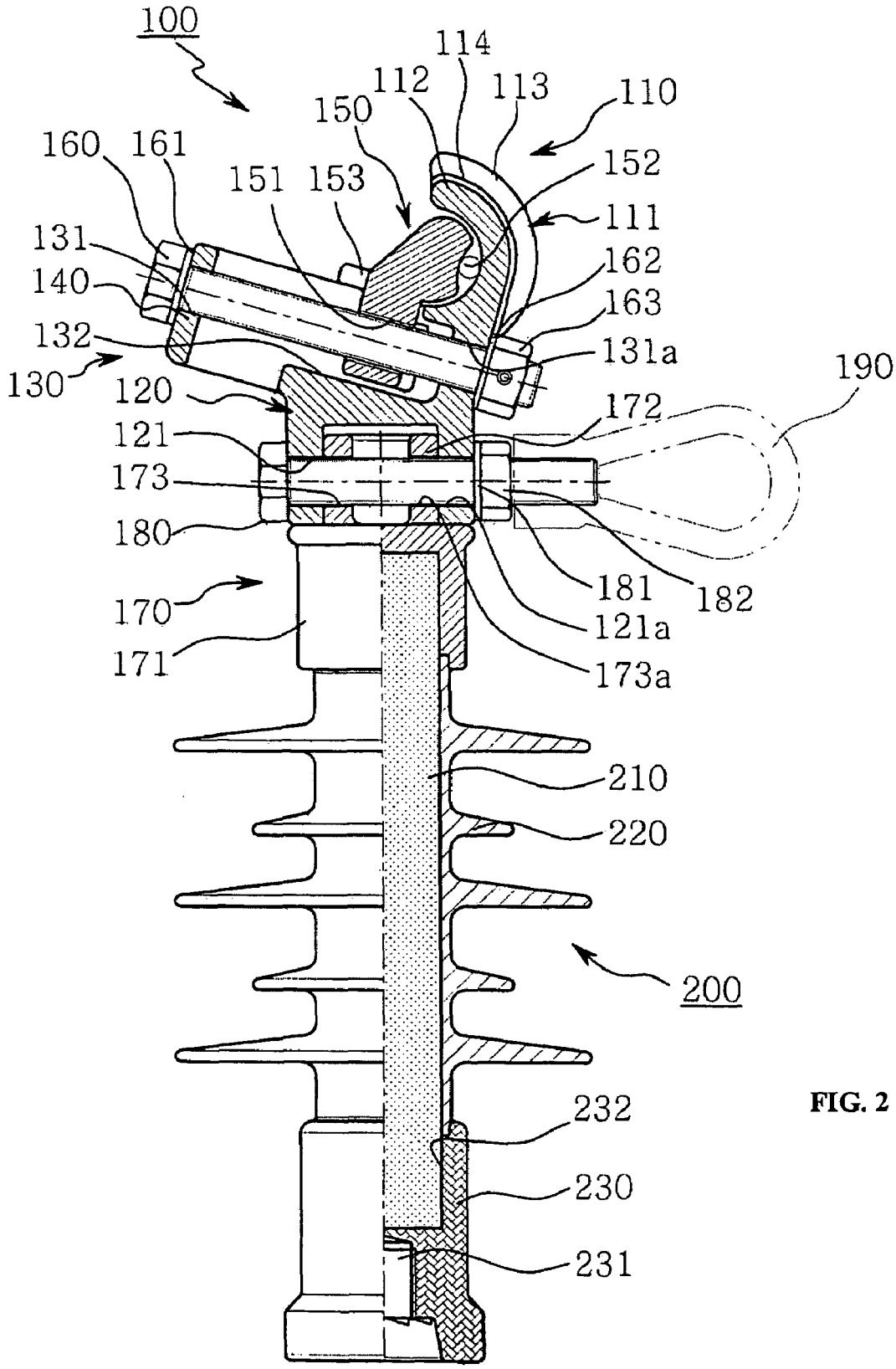
FIG. 2 is a side view, partly in section, of the insulator.
Figure 3:
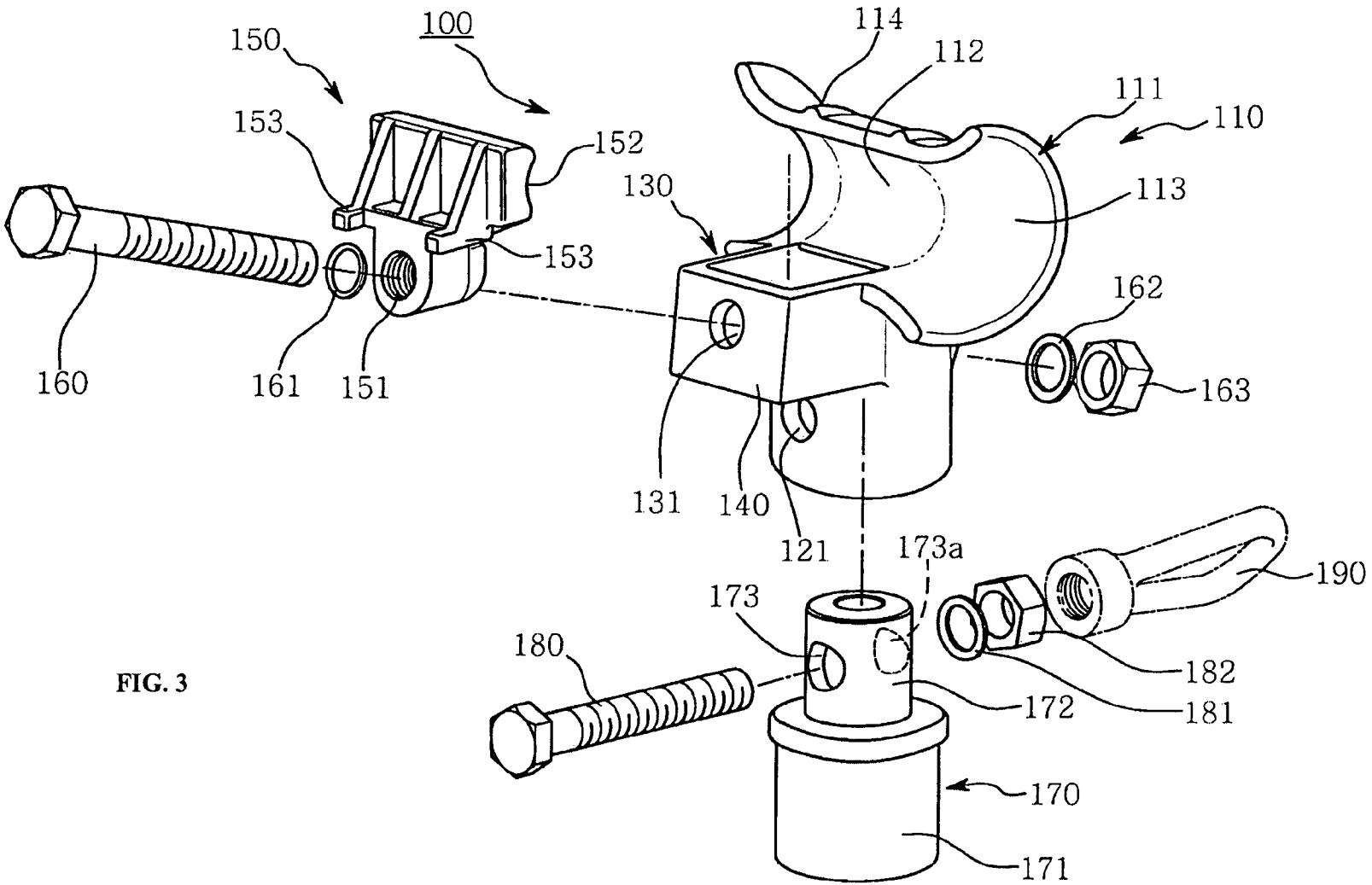
FIG. 3 is an exploded perspective view of the end clamp of the insulator
Figures 4, 4A:
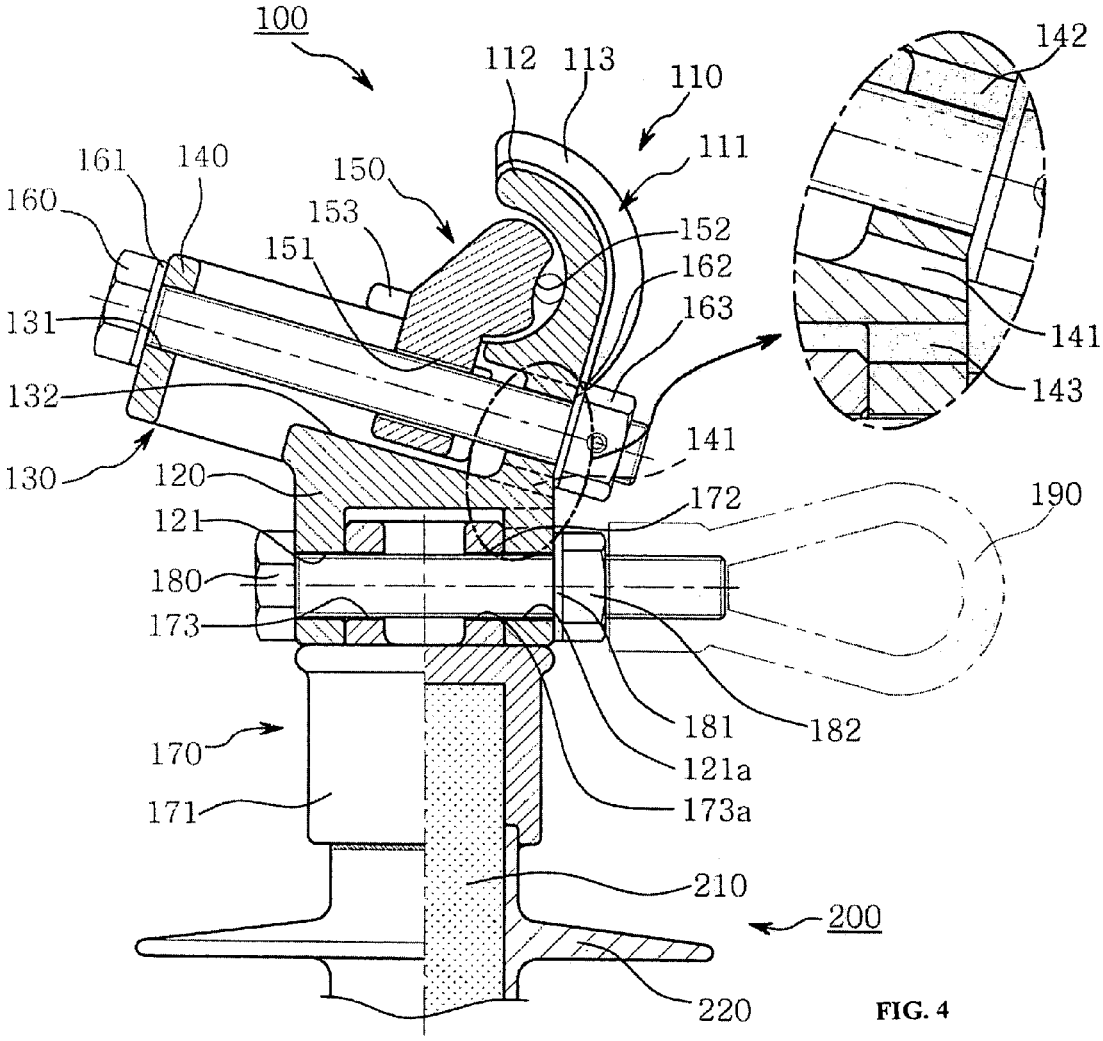
FIG. 4 is an enlarged sectional view of the end clamp shown in FIG. 2.
FIG. 4*a* is an enlarged view of a portion of FIG. 4.
Figure 5:
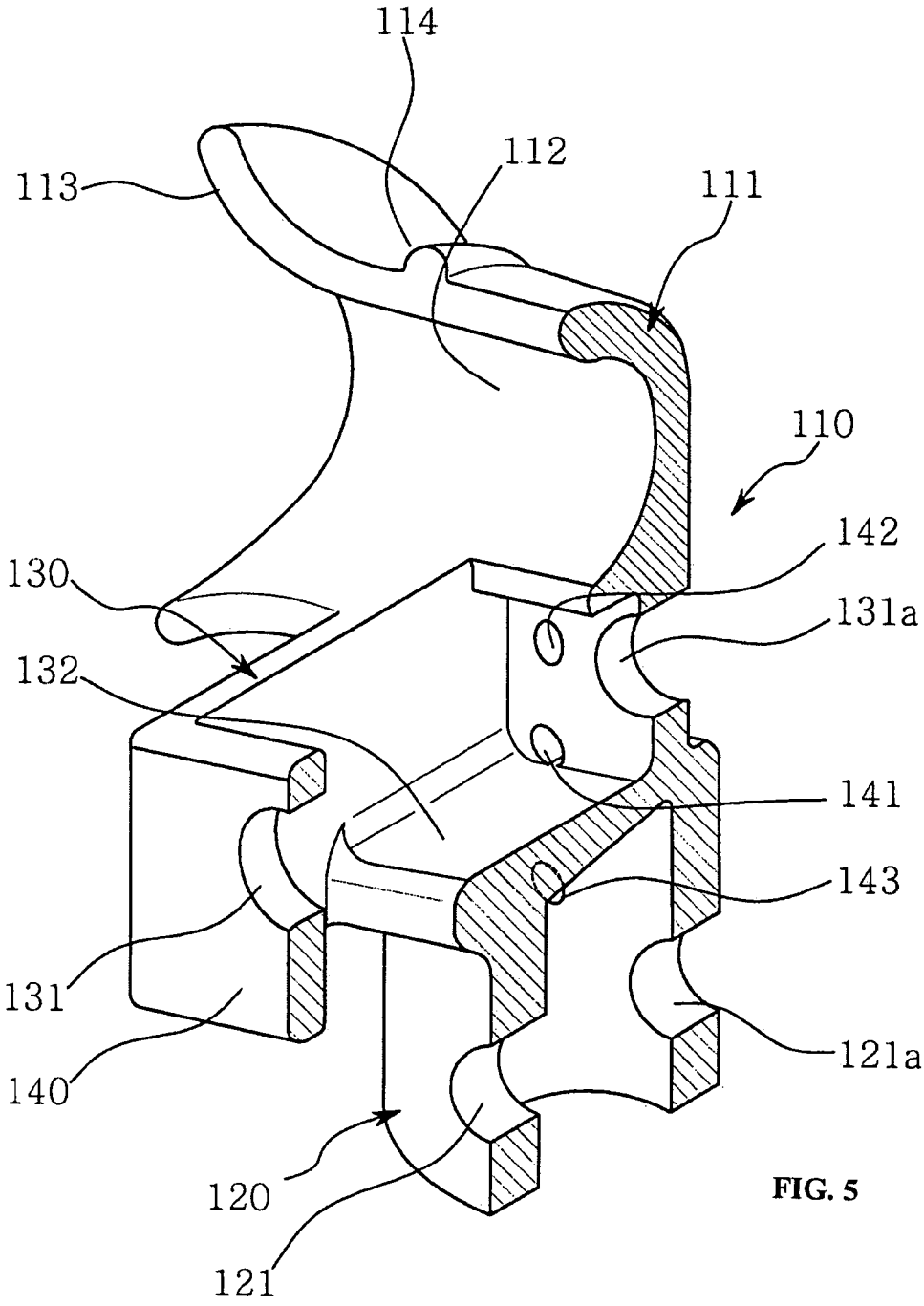
FIG. 5 is a partially cutaway perspective view of the end clamp.
Figure 6:
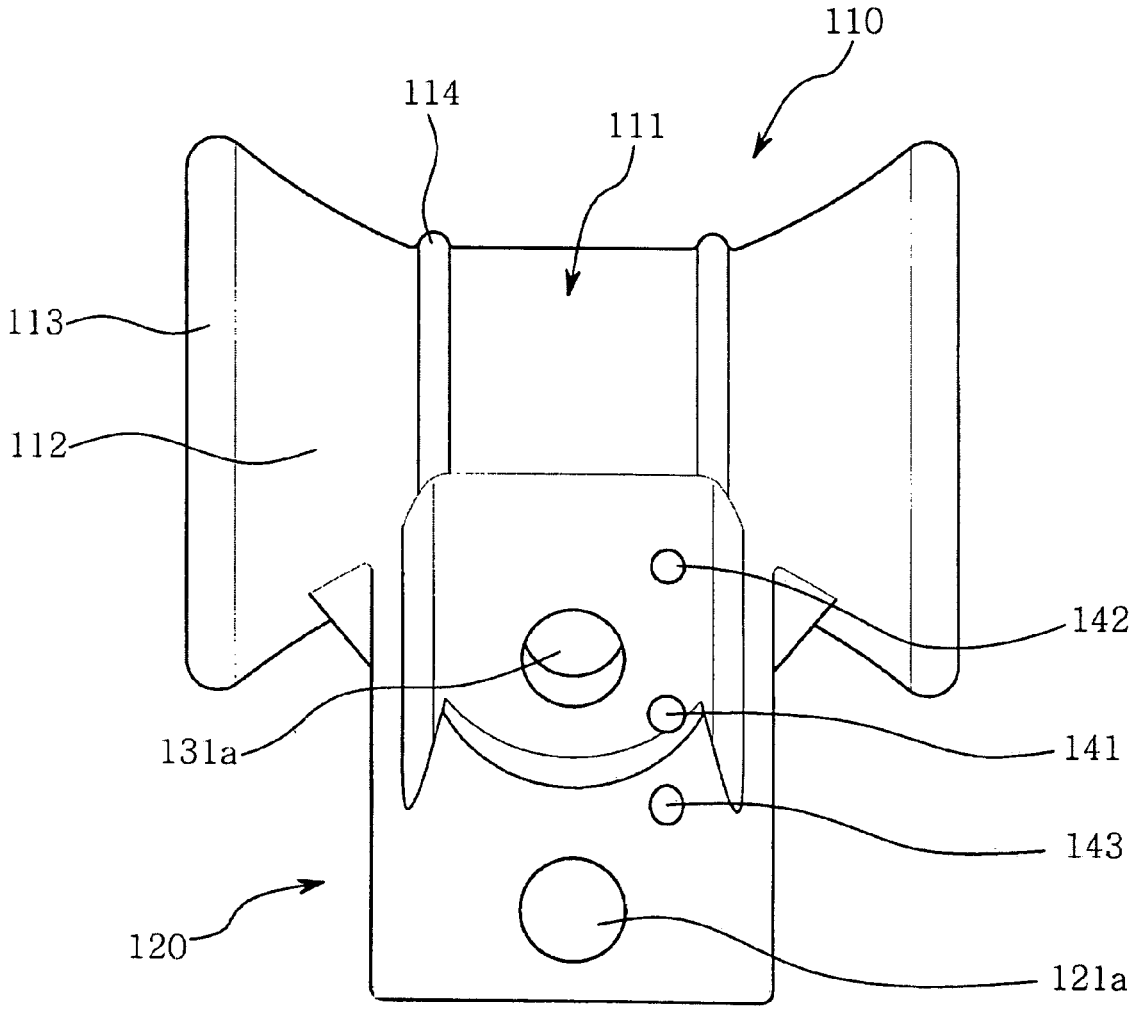
FIG. 6 is a rearview of the end clamp.

As shown in FIGS. 1 to 5, an electrical power line insulator has an end clamp 100 fastened to the upper end of an insulator housing 200 using a bolt 180 and a nut 182, so that it is possible to easily separate the end clamp 100 and the insulator housing 200 from each other.

The insulator housing 200 includes a post 210 in the form of an FRP rod. The post 210 is coupled to the insulator housing 200 by insert forming using insulating rubber 220. The post 210 is inserted into the insulator housing 200 such that both sides of the post, that is to say the upper and lower portions of the post 210, protrude therefrom by a predetermined distance. An upper fitting part 170 and a lower base fitting part 230 are assembled with the upper and lower portions of the post 210.

The post 210, the insulating rubber 220, and the base fitting part 230 of the insulator housing 200 are equivalent to those of a conventional insulator housing. The insulating rubber 220 may have a plurality of skirts having the shape of pleats so as to increase the insulating distance.

The base fitting part 230 has a cylindrical shape. A screw hole 231 is formed in the lower portion of the base fitting part 230 for mounting the insulator on an electric pole. Further, a cylindrical assembly recess 232 for receiving the post 210 is formed on the upper portion of the base fitting part 230. Thus, the lower end of the post 210 is fitted into a cylindrical assembly recess 232, and is compressed using a compression tool (not shown), such as a die, so as to be assembled with the recess 232.

Further, the upper end of the post 210 is fitted into a compression cylinder 171 provided in the lower portion of the upper fitting part 170, and is compressed using a compression tool, such as a die, in the same manner as the base fitting part 230.

The end clamp 100 includes a saddle 111, a track 130, a clamp 110, a keeper 150, and a bolt 160 and nut 163. The saddle 111 receives an electrical wire. The track 130 is provided on the front of the saddle 111. The clamp 110 comprises a cylindrical clamp base 120 provided on the lower portion of the track 130 and the saddle 111. The keeper 150 compresses and supports the electrical wire which is guided to the track 130 and seated in the saddle 111. The bolt 160 and the nut 163 are guided to the track 130, thus moving the keeper 150.

The upper fitting part 170 is assembled with the post 210 of the insulator housing 200. An assembly cylinder 172 protrudes integrally from the upper portion of the upper fitting part 170 so as to be connected to the clamp base 120 of the damp 110.

The saddle 111 includes a semicircular seat 112 and enlarged parts 113. One side of the saddle 111 is cut to form the open semicircular seat 112, thus the electrical wire is seated in the seat 112. The enlarged parts 113 are provided on both sides of the semicircular seat 112, and are bent outwards to be enlarged.

Reinforcing ribs 114 are integrally formed on both sides of the seat 112 to protrude from the seat 112. The reinforcing ribs 114 are provided between the enlarged parts 113 integrally formed on both sides of the seat 112 to be spaced apart from each other at a predetermined interval, and are provided on the outer circumference of the seat 112, thus reinforcing the seat 112.

After the insulator has been installed, the reinforcing ribs 114 prevent the insulator from being deformed or damaged by the load of the electrical wire when an external force, such as strong wind, acts on the electrical wire, thus prolonging the life span of the insulator.

Further, the track 130 provided on the front of the saddle 111 protrudes and has a rectangular shape, and the cylindrical clamp base 120 which is open at a lower portion thereof is provided on the lower portion of the track 130. A bolt hole 131 is formed in a vertical wall 140 forming one side of the track 130 protruding from the saddle 111, so that the vertical wall 140 is fastened to the keeper 150 using the bolt. Further, a bolt hole 131*a* is formed in a vertical wall 140*a* provided under the saddle 111 in such a way as to be opposite the bolt hole 131. Bolt holes 121 and 121*a* are formed through the clamp base 120 in the same direction as the bolt holes 131 and 131*a*.

Further, the track 130 includes a floor 132 which is spaced by a predetermined distance from the vertical wall 140 and extends to the clamp base 120 to be located around the saddle 111. Drain holes 141 and 142 are formed through the upper and lower portions of the vertical wall 140*a*, which extends perpendicular to the floor 132, and communicate with the exterior, thus discharging rainwater to the exterior, and preventing rainwater from collecting.

A drain hole 143 is formed through the upper surface of the clamp base 120 to discharge rainwater to the exterior.

The keeper 150 has a compression surface 152, a threaded hole 151, and guide surfaces 153. The compression surface 152, which contacts the electrical wire, is formed to be concave. The threaded hole 151, having an internal thread, is formed at a lower position behind the compression surface 152 such that the keeper 150 itself moves forwards and backwards. The guide surfaces 153 protrude backwards from both sides of the keeper 150 in the longitudinal direction thereof, and contact the upper surface of the track 130 to stably guide the keeper 150 when the keeper 150 moves forwards and backwards.

The keeper 150 accommodated in the track 130 is fastened via the bolt 160 to move forwards and backwards in a horizontal direction. The keeper 150 includes the bolt 160, an O-ring 161, a washer 162, and the nut 163. The bolt 160 is fastened to the keeper 150 and the track 130. The O-ring 161 is mounted to a bolt head. The washer 162 and the nut 163 are secured to the other end of the bolt 160 which protrudes out from the saddle 111.

In this case, the O-ring 161 functions to prevent the saddle 111 from being damaged due to friction between the saddle 111, which is made of cast aluminum, and the bolt 160, which is fastened to the saddle 111 and made of steel, in addition to preventing the bolt 160 from being loosened.

Further, the saddle 111 is provided to be inclined at a slight downward angle from the post 210, which is the central vertical axis of the insulator housing 200.

In other words, according to the present invention, when the insulator housing 200 is installed horizontally or vertically on a support structure (cross arm) of an electric pole, a predetermined depth is provided to the seat 112 of the saddle 111, thus safely and efficiently supporting an electrical wire seated in the seat 112.

Since the degree of inclination of the saddle 111 is already known to those skilled in the art, it will not be described herein.

The end clamp 100, is connected to the upper fitting part 170 coupled to the post 200. The upper fitting part 170 includes the solid assembly cylinder 172 and the hollow compression cylinder 171. The solid assembly cylinder 172 has the same shape as the cylindrical clamp base 120. The hollow compression cylinder 171 is integrally provided on the lower portion of the assembly cylinder 172, and is assembled with the post 210 which is a press fit therein.

The outer diameter of the assembly cylinder 172 is set such that the assembly cylinder 172 can be inserted into the clamp base 120. The assembly cylinder 172 has holes 173 and 173*a* corresponding to the bolt holes 121 and 121*a* of the cylindrical clamp base 120.

Further, the assembly cylinder 172 and the cylindrical clamp base 120 are coupled to each other by bolt 180 and a nut 182 so that they are not rotatable relative to each other. In order to prevent the nut 182 from being loosened, a washer 181 is secured to the bolt 180.

The length of the bolt 180 is set such that an end of the bolt 180 protrudes by a predetermined distance. An auxiliary tool 190 for holding a working tool, for example an eyenut, is secured to the protruding end of the bolt 180.

According to the present invention, the end clamp 100 and the insulator housing 200 are provided separately from each other. The end clamp 100 and the insulator housing 200 are assembled to each other via the bolt 180. The auxiliary tool 190 for holding a working tool is connected to the bolt 180. Next, as in the prior art, the electrical wire is moved using moving equipment, such as a pulley (not shown). After the electrical wire is seated in the seat 112 of the saddle 111 of the clamp 110, the keeper 150 is promptly tightened using the bolt. Stable coupling is thereby obtained.

In an electrical power line insulator having an end clamp according to the present invention, the cylindrical clamp base 120 is fitted over the assembly cylinder 172 of the upper fitting part 170 secured to an end (exposed portion) of the post 210, which is formed in the insulator housing 200 made of silicone rubber and comprises an FRP (fibre reinforced plastic) rod. In such a state, the holes 121, 121*a*, 173, and 173*a* are aligned with each other.

Next, the upper fitting part 170 of the insulator housing 200 and the end clamp 100 are fastened to each other using the bolt 180, the washer 181, and the nut 182.

Thereafter, the eyenut 190 for holding a working tool engages with a threaded part of the protruding bolt 180.

Meanwhile, when the keeper 150 is received in the track 130 of the saddle 111, the guide surfaces 153 of the keeper 150 contact the upper surface of the track 130, and the internal threaded hole 151 of the keeper 150 is aligned with the holes 131 and 131*a* of the track 130. After the O-ring 161 is secured to the bolt 160, the bolt 160 is passed through the aligned holes 131, 151, and 151*a*. The washer 162 and the nut 163 are secured to the bolt 160, which protrudes outwards and under the saddle.

Figure 7:
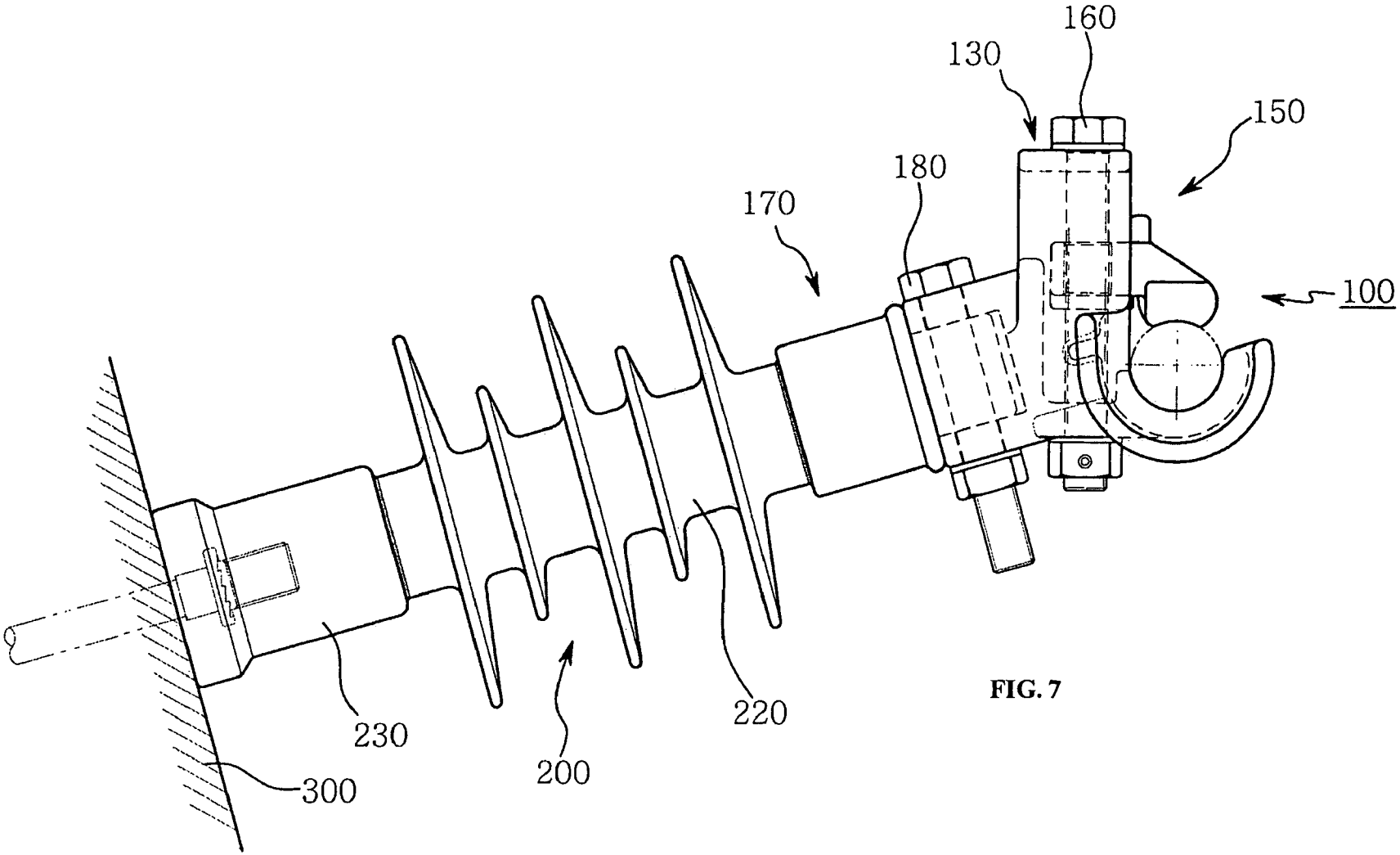
FIG. 7 is a side view showing the insulator installed in one manner.
Figure 8:
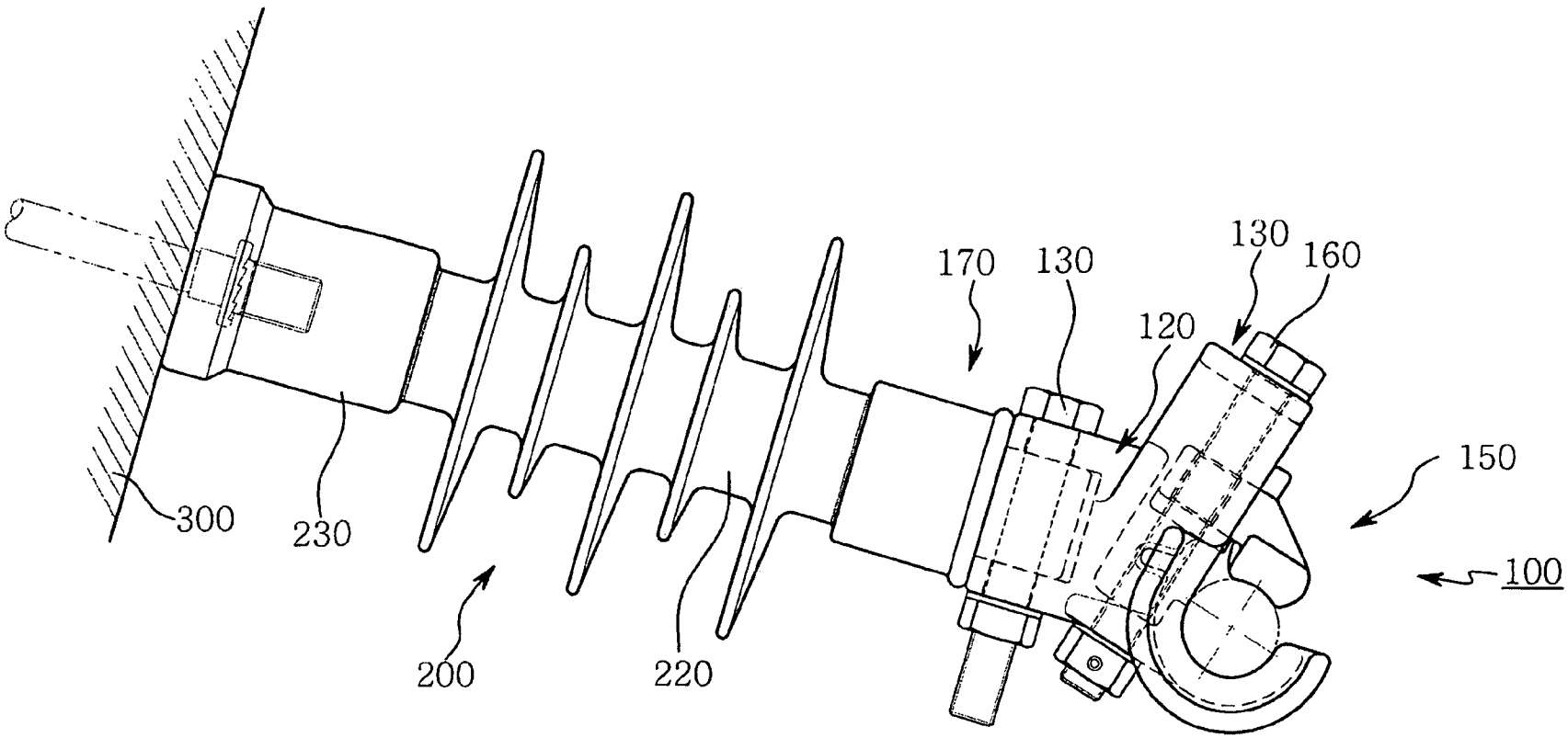
FIG. 8 is a similar view showing the insulator installed in another manner.

In this way, the end clamp 100 is fastened to the post 200 using the upper fitting part 170. After the fastening operation has been completed, the electrical power line insulator having the end clamp is mounted to an electrical wire pole or a steel tower 300, as shown in FIGS. 7 & 8, so that the electrical wire is seated in the saddle 111. By rotating the bolt 160 fastened to the saddle 111 clockwise or counterclockwise, the keeper 150, fastened to the bolt 160, is guided along the track 130 to move forwards and backwards, thus compressing and supporting the electrical wire in the saddle 111.

In this case, since the compression surface 152 of the keeper 150 compressing the outer circumferential surface of the electrical wire is formed to be concave, the contact area between the keeper 150 and the electrical wire is further increased.

Further, the eyenut 190 for holding a working tool may be secured to an end of the bolt 180 of the upper fitting part 170. The auxiliary tool may be used as a means for temporarily holding the electrical wire (electrical power line).

As shown in FIGS. 7 and 8, the electrical power line insulator having the end clamp according to the present invention may be installed such that the post 210, which is the central vertical axis of the insulator housing 200, forms a predetermined angle with a horizontal line, according to the installation conditions.

When the electrical power line insulator is installed as shown in FIG. 7, rainwater is smoothly discharged through the drain hole 141 which is formed through the lower surface of the vertical wall 140, thus maximally preventing corrosion, therefore preventing breakdown, as in the vertical installation.

Meanwhile, when the end clamp 110 is installed to be under the insulator housing 200, that is, a horizontal line, as shown in FIG. 8, rainwater entering the insulator is smoothly discharged through the drain hole 143 formed through the upper surface of the clamp base 120 which is the coupling portion between the end clamp 110 and the insulator housing 200, and the drain hole 142 formed through the upper surface of the vertical wall 140*a* of the track 130, thus maximizing the risk corrosion and preventing breakdown.

The insulator of the present invention is constructed so that the insulator housing and the end clamp are separated from each other, and form a firm structure after being coupled to each other. Further, rainwater collected in the coupling portion and the track due to installation can be smoothly discharged to the exterior, thus preventing breakdown. Furthermore, the end clamp can be conveniently and easily replaced with another one to be suitable for the size of an electrical wire.

As described above, the present invention provides an electrical power lined insulator having an end clamp, which is capable of easily mounting and using a working tool for moving an electrical wire, and firmly compresses or releases the electrical wire seated in a saddle by simply rotating a bolt to move a keeper, and preventing rainwater from collecting in a damp and preventing corrosion, therefore having a prolonged life span and preventing accidents.

Although a preferred embodiment of the present invention has been disclosed for illustrative purposes, those skilled in the art will appreciate that various modifications, additions and substitutions are possible, without departing from the scope and spirit of the invention as defined in the accompanying claims.

What is claimed is:

1. An electrical power line insulator having an end clamp with a saddle for supporting an electrical wire, and a track provided on a front surface of the saddle, a keeper for compressing and supporting an electrical wire seated in the saddle, and a bolt and a nut for fastening the keeper to the saddle and operable to horizontally move the keeper along the track, and an insulator housing secured to the end clamp and mounted on a support structure, the end clamp and the insulator housing being detachably assembled with each other by means of:

a cylindrical clamp base integrally provided on a lower portion of the saddle and the track of the clamp; and an upper fitting part comprising:

an assembly cylinder provided on an upper portion of the fitting part to be connected to the cylindrical clamp base;

a compression cylinder provided on a lower portion of the fitting part and pressed against a post of the insulator housing; and a bolt and a nut fastening the cylindrical clamp base of the clamp to the assembly cylinder of the upper fitting part.

2. An electrical power line insulator according to claim 1, wherein an end of the bolt for fastening the clamp base to the assembly cylinder protrudes a predetermined distance, and an eyenut for holding a tool or an auxiliary tool for holding electrical wires is secured to the end of the bolt.

3. An electrical power line insulator according to claim 2, wherein the bolt to which the eyenut for holding a tool is secured and the bolt for moving the keeper forwards and backwards are separately installed.

4. An electrical power line insulator according to claim 1, wherein a drain hole is formed in each of the track of the clamp and the clamp base, thus preventing rainwater from collecting therein.

5. An electrical power line insulator according to claim 1, wherein the saddle of the clamp has reinforcing ribs, the reinforcing ribs being provided on an outer portion of a seat in which the electrical wire is seated.

6. An electrical power line insulator according to claim 1, wherein the keeper has:

a compression surface formed such that a surface thereof contacting the electrical wire is concave to correspond to the shape of the electrical wire;

an internally threaded hole formed in a lower portion behind the compression surface such that the keeper itself moves forwards and backwards; and guide surfaces protruding backwards in a longitudinal direction and contacting an upper surface of the track to stably guide the track when the keeper moves forwards and backwards.

7. An electrical power line insulator, comprising:

an end clamp comprising:

a saddle for supporting an electrical wire;

a keeper for compressing and supporting the electrical wire seated in the saddle;

a track integrated with the saddle to move the keeper toward the saddle; and a cylindrical clamp base integrated with the saddle to support and connect the saddle and the keeper; and an upper fitting part of an insulator housing, having:

an assembly cylinder provided on an upper portion of the upper fitting part and connected to the cylindrical clamp base of the end clamp;

a compression cylinder provided on a lower portion of the upper fitting part and connected to a post of the insulator housing;

a bolt protruding from the clamp base; and bolts and nuts fastening the keeper to the saddle so as to horizontally move the keeper received in the track, and fastening the clamp base to the assembly cylinder, respectively.

* * * * *